US008080815B2

(12) United States Patent
Nutt

(10) Patent No.: US 8,080,815 B2
(45) Date of Patent: Dec. 20, 2011

(54) BIOMARKER GENERATOR

(75) Inventor: Ronald Nutt, Friendsville, TN (US)

(73) Assignee: ABT Molecular Imaging, Inc., Knoxville, TN (US)

( * ) Notice: Subject to any disclaimer, the term of this patent is extended or adjusted under 35 U.S.C. 154(b) by 180 days.

(21) Appl. No.: 12/690,900

(22) Filed: Jan. 20, 2010

(65) Prior Publication Data

US 2010/0127188 A1 May 27, 2010

Related U.S. Application Data

(63) Continuation-in-part of application No. 12/333,300, filed on Dec. 11, 2008, now Pat. No. 7,884,340, which is a continuation-in-part of application No. 11/441,999, filed on May 26, 2006, now Pat. No. 7,476,883, and a continuation-in-part of application No. 11/736,032, filed on Apr. 17, 2007, now Pat. No. 7,466,085.

(51) Int. Cl.
*G21G 1/10* (2006.01)

(52) U.S. Cl. ..... 250/492.3; 376/190; 376/195; 376/198

(58) Field of Classification Search ..... 250/492.3; 376/190, 194, 195, 196, 197, 198
See application file for complete search history.

(56) References Cited

U.S. PATENT DOCUMENTS

| | | | | |
|---|---|---|---|---|
| 5,037,602 | A * | 8/1991 | Dabiri et al. | 376/198 |
| 7,394,081 | B2 * | 7/2008 | Okazaki et al. | 250/492.3 |
| 2004/0046116 | A1 | 3/2004 | Schroeder et al. | |
| 2006/0049902 | A1 | 3/2006 | Kaufman | |
| 2008/0067413 | A1 | 3/2008 | Nutt | |
| 2008/0258653 | A1 | 10/2008 | Nutt | |
| 2009/0218520 | A1 | 9/2009 | Nutt | |

* cited by examiner

*Primary Examiner* — Kiet Nguyen
(74) *Attorney, Agent, or Firm* — Pitts, Lake & Bell, PC

(57) ABSTRACT

An improved biomarker generator and a method suitable for efficiently producing short lived radiopharmaceuticals in quantities on the order of a unit dose. The improved biomarker generator includes a particle accelerator and a radiopharmaceutical micro-synthesis system. The micro-accelerator of the improved biomarker generator is optimized for producing radioisotopes useful in synthesizing radiopharmaceuticals in quantities on the order of one unit dose allowing for significant reductions in size, power requirements, and weight when compared to conventional radiopharmaceutical cyclotrons. The radiopharmaceutical micro-synthesis system of the improved biomarker generator is a small volume chemical synthesis system comprising a microreactor and/or a microfluidic chip and optimized for synthesizing the radiopharmaceutical in quantities on the order of one unit dose allowing for significant reductions in the quantity of radioisotope required and the processing time when compared to conventional radiopharmaceutical processing systems.

26 Claims, 10 Drawing Sheets

METHOD FOR GENERATING A UNIT DOSE OF BIOMARKER

METHOD FOR GENERATING A UNIT DOSE OF BIOMARKER

BIOMARKER GENERATOR

CROSS-REFERENCE TO RELATED APPLICATIONS

This application is a continuation-in-part of U.S. application Ser. No. 12/333,300, filed Dec. 11, 2008, which is a continuation-in-part of U.S. application Ser. No. 11/441,999, filed May 26, 2006 and a continuation-in-part of U.S. application Ser. No. 11/736,032, filed Apr. 17, 2007, now U.S. Pat. No. 7,466,085.

STATEMENT REGARDING FEDERALLY-SPONSORED RESEARCH OR DEVELOPMENT

Not Applicable

BACKGROUND OF THE INVENTION

1. Field of Invention

This invention relates to a method and apparatus for producing of radiopharmaceuticals.

2. Description of the Related Art

Cyclotrons are used to generate high energy charged particle beams for purposes such as nuclear physics research and medical treatments. One area where cyclotrons have found particular utility is in the generation of radiopharmaceuticals, also known as biomarkers, for medical diagnosis by such techniques as positron emission tomography (PET). A conventional cyclotron involves a substantial investment, both in monetary and building resources. An example of one of the more compact conventional cyclotrons used for radiopharmaceutical production is the Eclipse RD developed by the company founded by the present inventor and now produced by Siemens. The self-shielded version of the Eclipse RD can be installed in a facility without a shielded vault. The minimum room size for housing the Eclipse RD is 7.31 m×7.01 m×3 m (24 ft×23 ft×10 ft). To support the approximately 29 300 kg (64 400 lbs) installed weight of a self-shielded Eclipse RD, the cyclotron room includes a concrete pad with a minimum thickness of 36 cm (14 in). In addition to a large size and weight, the power requirements often involve a dedicated and substantial electrical power system. The minimum electrical service required for the Eclipse RD is a 208 (±5%) VAC, 150 A, 3-phase service. Thus, medical facilities have a need for biomarkers, but the monetary, structural, and power requirements of conventional cyclotrons have historically made it impracticable for most hospitals and other medical facilities to produce biomarkers on-site.

The half-life of clinically important positron-emitting isotopes, i.e., radionuclides, relative to the time required to process a radiopharmaceutical is a significant factor in biomarker generation. The large linear dimensions of the reaction vessel in radiochemical synthesis systems commonly used in biomarker generators result in a small ratio of surface area-to-volume and effectively limit the heat transfer and mass transport rates and lengthens processing time. The four primary PET radionuclides, fluorine-18, carbon-11, nitrogren-13, and oxygen-15, have short half-lives (approximately 110 min, 20 min, 10 min, and 2 min, respectively).

Consider the case of the production of [$^{18}$F]2-fluoro-2-deoxy-D-glucose, commonly referred to as [$^{18}$F]FDG. Converting nucleophilic fluorine-18 ([$^{18}$F]F$^-$) into [$^{18}$F]FDG requires up to 45 min using one of the larger conventional radiochemical synthesis systems, such as the Explora FDG$_4$ radiochemistry module, originally developed by a company founded by the present inventor and now produced by Siemens. The processing time is significant with respect to the half-life of the radioisotope. Accordingly, the production yield fraction of a biomarker of a conventional radiopharmaceutical synthesis system is far from ideal, often limited to a range of approximately 50% to 60% of the component substances. For the Explora FDG$_4$, the processing time fraction is approximately 40% of the half-life of the [$^{18}$F]F$^-$ radioisotope. Corrected to the end of bombardment, the Explora FDG$_4$ has an yield fraction of approximately 65%. The limitations of the larger conventional radiochemical synthesis systems are even more evident when preparing biomarkers that are labeled with the radioisotopes having shorter half-lives. A conventional radiopharmaceutical synthesis system is designed to process a significant quantity of radioactivity. For example, the Explora FDG$_4$ accepts up to 333 GBq (9000 mCi) of [$^{18}$F]F$^-$. During bombardment, a significant percentage of the newly generated radioisotope decays back to its original target state requiring extended bombardment times to produce a sufficient quantity of the radioisotope for use in a conventional radiopharmaceutical synthesis system. For example, the production of approximately 90 GBq (2400 mCi) of [$^{18}$F]F$^-$ requires a bombardment time of approximately 120 min using the Eclipse RD cyclotron. Even with efficient distribution networks, the short half-lives and low yields require production of a significantly greater amount of the biomarker than is actually needed for the intended use. In contrast, the radioactivity of a unit dose of a biomarker administered to a particular class of patient or subject for medical imaging is considerable smaller, generally ranging from 0.185 GBq to 0.555 GBq (5 mCi to 15 mCi) for human children and adults and from 3.7 MBq to 7.4 MBq (100 μCi to 200 μCi) for mice.

Recent advancements have led to the development of smaller reaction systems using microreaction or microfluidic technology. By reducing the linear dimensions of the reaction vessel used in the radiochemical synthesis system, the ratio of surface area-to-volume and, consequently, heat transfer and mass transport rates increases. The smaller size of the reaction vessels lends itself to replication allowing multiple reaction vessels to be placed in parallel to simultaneously process the biomarker. In addition to faster processing times and reduced space requirements, these smaller reaction systems require less energy.

In the radiopharmaceutical area, a 2005 article discusses production of 0.064 GBq (1.74 mCi) of [$^{18}$F]FDG, a quantity sufficient for several positron emission tomography (PET) imaging studies on mice, using an integrated microfluidic circuit as proof of principle for automated multistep synthesis at the nanogram to microgram scale. Chung-Cheng Lee, et al., *Multistep Synthesis of a Radiolabeled Imaging Probe Using Integrated Microfluidics*, Science, Vol. 310, no. 5755, (Dec. 16, 2005), pp. 1793, 1796. The authors conclude that their chemical reaction circuit design should eventually yield sufficiently large quantities (i.e., >100 mCi) of [$^{18}$F]FDG to produce multiple doses for use in PET imaging of humans. The commercially available NanoTek Microfluidic Synthesis System distributed by Advion BioSciences, Inc., can synthesize [$^{18}$F]FDG 35 times faster than with conventional macrochemistry, which clearly represents a significant improvement in radiopharmaceutical processing time. However, such level of advancement has not been seen with the cyclotrons producing the radioisotopes used in radiopharmaceutical synthesis. However, such level of advancement has not been seen with the cyclotrons producing the radioisotopes used in radiopharmaceutical synthesis.

A conventional cyclotron used in the production of radioisotopes for synthesizing radiopharmaceuticals has significant power requirements. Typically, a conventional cyclotron for radiopharmaceutical production generates a beam of charged particles having an average energy in the range of 11 MeV to 18 MeV, a beam power in the range of 1.40 kW and 2.16 kW, and a beam current of approximately 120 μA. The weight of an electromagnet of such a conventional cyclotron for radiopharmaceutical production typically ranges between 10 tons and 20 tons. The Eclipse RD is an 11 MeV negative-ion cyclotron producing up to two particle beams each with a 40 μA beam current. The major power consuming components of a cyclotron are typically the magnet system power supply, the RF system amplifier, the ion source transformer, the vacuum system cryopump compressor, and the water system. Of these, the magnet system power supply and the RF system amplifier are the most significant. The operating power consumption of the Eclipse RD is specified at 35 kW. The standby power consumption of the Eclipse RD is specified at less than 7 kW. The magnet system of the Eclipse RD produces a mean field of 1.2 T using 3 kW of power. The RF system of the Eclipse RD has a maximum amplifier power of 10 kW. The ion source system of the Eclipse RD is specified for a maximum $H^-$ current of 2 mA.

FIG. 1 is a representative illustration of an array of dees in a conventional cyclotron. For simplicity, only two dees 12 are illustrated. However, there are typically four or more dees used. Cyclotrons having fewer dees require more turns in the ion acceleration path, a higher acceleration voltage, or both to energize the ions to the desired level. The dees 12 are positioned in the valley of a large electromagnet and enclosed in a vacuum tank. During operation of the cyclotron, an ion source 81 continuously generates ions 19 through the addition or subtraction of electrons from a source substance. As the ions 19 are introduced into the cyclotron at the center of the array of dees 12, they are exposed a strong magnetic field generated by opposing magnet poles 11 situated above and below the array of dees 12. A radio frequency (RF) oscillator applies a high frequency, high voltage signal to each of the dees 12 causing the charge of the electric potential developed across each of the dees 12 to alternate at a high frequency. Neighboring dees are given opposite charges such that ions 19 entering the gap between neighboring dees 12 see a like charge on the dee behind them and an opposite charge on the dee ahead of them, which results in acceleration (i.e., increasing the energy) of the ions 19. With each energy gain, the orbital radius of the ions 19 increases. The result is a stream of ions 19 following an outwardly spiraling path. The ions 19 ultimately exit the cyclotron as a particle beam 40 directed at a target 89.

FIG. 2 illustrates an exploded view of selected components of a representative conventional two-pole cyclotron using the concept of sector-focusing to constrain the vertical dimension of the accelerated particle beam. The cyclotron includes upper and lower yokes 54 that cooperatively engage when assembled to define an acceleration chamber and opposing upper and lower magnet poles 11. Each magnet pole 11 includes two wedge-shaped pole tips 32, commonly referred to as "hills" where the magnetic flux 58 is mostly concentrated. The recesses between the hills 32 are commonly referred to as "valleys" 34 where the gap between the magnet poles 11 is wider. As a consequence of the wider gap between the magnets poles 11, the magnetic flux density in the valleys 34 is reduced compared to the magnetic flux density in the hills 32. A dee 12 is located in each open space defined by the corresponding upper and lower valleys 34. Vertical focusing of the beam is enhanced by a large hill field-to-valley field. A higher ratio indicates stronger magnetic forces, which tends to confine the beam closer to the median plane of the cyclotron. In principle, a tighter confinement allows reduction of the gap between the magnet poles without increasing the danger of the beam striking the pole faces of the magnet. For a given amount of flux, a magnet with a smaller gap between the magnet poles requires less electrical power for excitation than a magnet with a larger gap between the magnet poles. Once the ions are extracted from the cyclotron and are no longer under the influence of the magnet poles 11, a beam tube 92 directs the particle beam 40 through a collimator 96, which refines the profile of the particle beam 40 for irradiation of the target substance 100 contained in the target 89.

An unfortunate by-product of radioisotope production is the generation of potentially harmful radiation. The radiation generated as a result of operating a cyclotron is attenuated to acceptable levels by a shielding system, several variants of which are well known in the prior art. At the extraction point of a positive ion cyclotron, interaction between the positive ions 19*p* and the extraction blocks 102 used to induce the positive ions 19*p* to exit the cyclotron generate prompt high-energy gamma radiation and neutron radiation, a byproduct of nuclear reactions that produce radioisotopes. At the target 89, the nuclear reaction that occurs as the particle beam 40 irradiates the target substance 100 contained therein to produce the desired radioisotope generates prompt high-energy gamma radiation and neutron radiation. Additionally, residual radiation is indirectly generated by the nuclear reaction that yields the radioisotope. During the nuclear reaction, neutrons are ejected from the target substance and when they strike an interior surface of the cyclotron, gamma radiation is generated. Finally, direct bombardment of components such as the collimator 96 and the target window 98 by the particle beam 40 generates induced high-energy gamma radiation. Thus, a cyclotron must be housed in a shielded vault or be self-shielded. Although commonly composed of layers of exotic and costly materials, shielding systems only can attenuate radiation; they cannot absorb all of the gamma radiation or other ionizing radiation.

Following irradiation by the cyclotron, the target substance is commonly transferred to a radioisotope processing system. Such radioisotope processing systems are numerous and varied and are well known in the prior art. The radioisotope processing system prepares the radioisotope for the tagging or labeling of molecules of interest to enhance the efficiency and yield of the radiopharmaceutical synthesis processes. For example, the radioisotope processing system may extract undesirable molecules, such as excess water or metals to concentrate or purify the target substance.

BRIEF SUMMARY OF THE INVENTION

An improved biomarker generator and a method suitable for efficiently producing short lived radiopharmaceuticals in quantities on the order of a unit dose is described in detail herein and illustrated in the accompanying figures. The improved biomarker generator includes a particle accelerator and a radiopharmaceutical micro-synthesis system. The micro-accelerator of the improved biomarker generator is optimized for producing radioisotopes useful in synthesizing radiopharmaceuticals in quantities on the order of one unit dose allowing for significant reductions in size, power requirements, and weight when compared to conventional radiopharmaceutical cyclotrons. The radiopharmaceutical micro-synthesis system of the improved biomarker generator is a small volume chemical synthesis system comprising a microreactor and/or a microfluidic chip and optimized for synthesizing the radiopharmaceutical in quantities on the order of one unit dose allowing for significant reductions in the quantity of radioisotope required and the processing time when compared to conventional radiopharmaceutical processing systems.

The improved biomarker generator includes a small, low-power particle accelerator (hereinafter "micro-accelerator") for producing approximately 1 unit dose of a radioisotope that is chemically bonded (e.g., covalently bonded or ionically bonded) to a specific molecule. The micro-accelerator produces per run a maximum quantity of radioisotope that is approximately equal to the quantity of radioisotope required by the radiopharmaceutical micro-synthesis system to synthesize a unit dose of biomarker. The micro-accelerator takes advantage of various novel features, either independently or in combination to reduce size, weight, and power requirements and consumption. The features of the micro-accelerator described allow production of a radioisotope with a maximum radioactivity of approximately 2.59 GBq (70 mCi) using a particle beam with an average energy in the range of 5 MeV to 18 MeV or in various sub-ranges thereof and a maximum beam power in the range of 50 W to 200 W.

One feature of the micro-accelerator is the use of permanent magnets to contain the ions during acceleration and eliminate the electromagnetic coils of the common to conventional radiopharmaceutical cyclotrons. Each of the permanent magnets and the dees are wedge-shaped and arranged into a substantially circular array. A series of collimator channels in selected dees initially direct the path of the ions introduced at the center of the array. After exiting the series of collimator channels, the ions travel through the main channels of the dees until the desired energy level is achieved. The permanent magnet cyclotron provides substantial improvements with respect to cost, reliability, size, weight, infrastructure requirements, and power requirements compared to conventional radiopharmaceutical cyclotrons.

Another feature of the micro-accelerator is the use of an improved radio frequency (RF) system powered by a rectified RF power supply. A rectified input supplies a high voltage transformer to supply power to the RF oscillator. The RF signal produced by the RF system is high peak-to-peak voltage at the resonant frequency of the RF oscillator enveloped by the line voltage frequency. The charged particles are only accelerated during a portion of the line voltage cycle. The resulting RF power supply compensates for reduced activity by increasing the current.

A still further feature of the micro-accelerator is the use of an internal target cyclotron where the target is located within the magnetic field and the particle beam irradiates the internal target while still within the magnetic field. This allows the magnet system to assist in containing harmful radiation related to the nuclear reaction that converts the target substance into a radioisotope and eliminates a major source of radiation inherent in a conventional positive-ion cyclotron. As a result, the micro-accelerator can take advantage of the benefits without a significant disadvantage normally associated with a positive particle beam. Beams of positively-charged particles generally are more stable than beams of negatively-charged particle because the reduced likelihood of losing an electron at the high velocities that charged particles experience in a cyclotron. Losing an electron usually causes the charged particle to strike an interior surface of the cyclotron and generate additional radiation. Minimizing the production of excess radiation reduces the amount of shielding required. Additionally, a positive ion cyclotron requires significantly less vacuum pumping equipment. Reducing the amount of shielding and vacuum pumping equipment reduces the size, weight, cost, complexity, power requirements, and power consumption of the cyclotron.

Through the use of microreactors and microfluidic chips, which have fast processing times and offer precise control over the various stages of a chemical process, the radiopharmaceutical micro-synthesis system provides a significant reduction in processing time that directly reduces the quantity of the radioisotope required to synthesize the desired biomarker.

The method for producing a radiopharmaceutical using the improved biomarker generator calls for providing a micro-accelerator, producing charged particles, accelerating the charged particles, and forming a particle beam to irradiate a target substance and produce a radioisotope. The improved biomarker generator allows operation using a volume of the target substance that is unusually small in the area of radiopharmaceutical production. After irradiation, the radioisotope and at least one reagent are transferred to the radiopharmaceutical micro-synthesis system. The radioisotope undergoes processing as necessary. Ultimately, the radiopharmaceutical micro-synthesis system combines the radioisotope with the reagent or reagents to synthesize the biomarker.

The system includes a radiopharmaceutical micro-synthesis system having at least one microreactor and/or microfluidic chip. Using the unit or precursory unit dose of the radioisotope and at least one reagent, the radiopharmaceutical micro-synthesis system synthesizes on the order of a unit dose of a biomarker. Chemical synthesis using microreactors or microfluidic chips (or both) is significantly more efficient than chemical synthesis using conventional macroscale chemical synthesis technology. Yields are higher and reaction times are shorter, thereby significantly reducing the quantity of radioisotope required in synthesizing a unit dose of biomarker. Accordingly, because the micro-accelerator only produces relatively small quantities of radioisotope per production run, the maximum beam power of the micro-accelerator is approximately two to three orders of magnitude less than the beam power of a conventional particle accelerator. As a direct result of this dramatic reduction in maximum beam power, the micro-accelerator is significantly smaller and lighter than a conventional particle accelerator, has less stringent infrastructure requirements, and requires far less electricity. Additionally, many of the components of the small, low-power accelerator are less costly and less sophisticated, such as the magnet, magnet coil, vacuum pumps, and power supply, including the RF oscillator.

The synergy that results from combining the micro-accelerator and the radiopharmaceutical micro-synthesis system having at least one microreactor and/or microfluidic chip cannot be overstated. This combination, which is the essence of the improved biomarker generator, provides for the production of approximately one unit dose of radioisotope in conjunction with the nearly on-demand synthesis of one unit dose of a biomarker. The improved biomarker generator is an economical alternative that makes in-house biomarker generation at the imaging site a viable option even for small regional hospitals.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
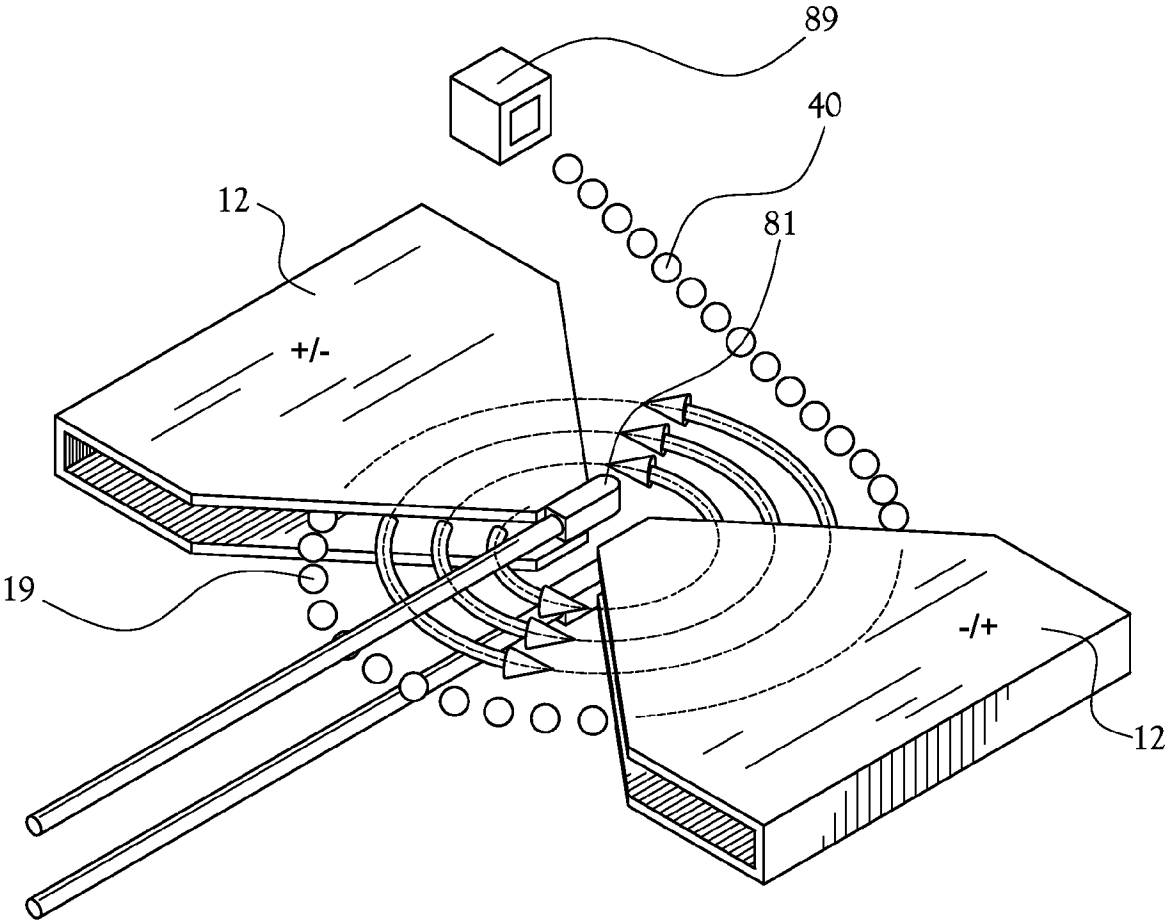
Fig. 1 (PRIOR ART)
FIG. 1 is a perspective view of the ionization and acceleration components disposed within a conventional cyclotron.
Figure 2:
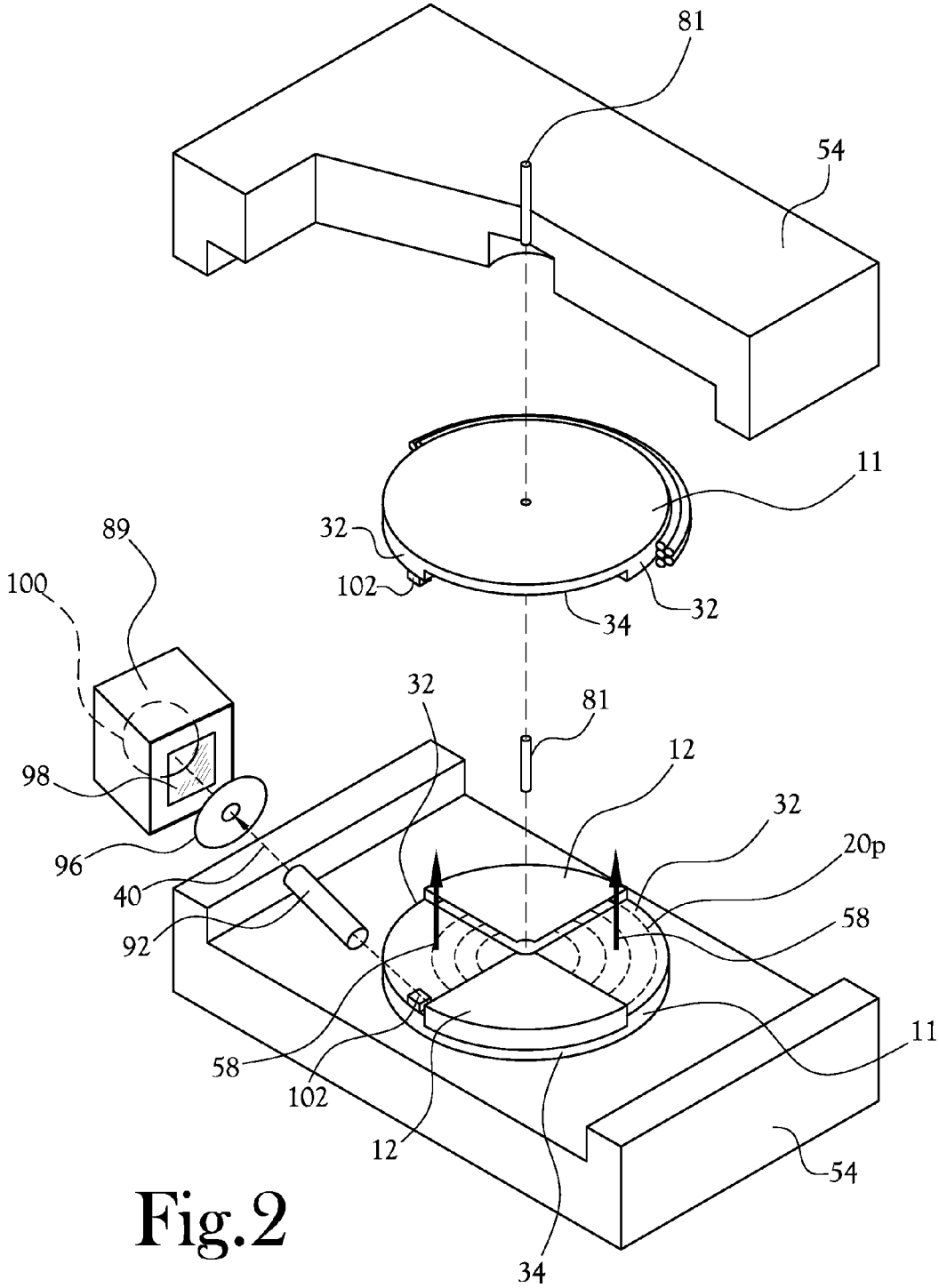
Fig.2 (PRIOR ART)
FIG. 2 is an exploded illustration of certain components of a prior art cyclotron.

An improved biomarker generator and a method suitable for efficiently producing short lived radiopharmaceuticals in quantities on the order of a unit dose is described in detail herein and illustrated in the accompanying figures. The improved biomarker generator includes a particle accelerator and a radiopharmaceutical micro-synthesis system. The micro-accelerator of the improved biomarker generator is optimized for producing radioisotopes useful in synthesizing radiopharmaceuticals in quantities on the order of one unit dose allowing for significant reductions in size, power requirements, and weight when compared to conventional radiopharmaceutical cyclotrons. The radiopharmaceutical micro-synthesis system of the improved biomarker generator is a small volume chemical synthesis system comprising a microreactor and/or a microfluidic chip and optimized for synthesizing the radiopharmaceutical in quantities on the order of one unit dose allowing for significant reductions in the quantity of radioisotope required and the processing time when compared to conventional radiopharmaceutical processing systems.

As used herein, "microreactors" and "microfluidic chips" refer broadly small volume reaction systems including microscale, nanoscale, and picoscale systems. As used herein, the term "radiopharmaceutical" encompasses any organic or inorganic compound comprising a covalently-attached radioisotope (e.g., 2-deoxy-2-[$^{18}$F]fluoro-D-glucose ([$^{18}$F]FDG)), any inorganic radioactive ionic solution (e.g., Na[$^{18}$F]F ionic solution), or any radioactive gas (e.g., [$^{11}$C]$CO_2$), particularly including radioactive molecular imaging probes intended for administration to a patient or subject (e.g., by inhalation, ingestion, or intravenous injection) for imaging purposes. Such probes are also referred to in the art as radiotracers and radioligands and, more generically, as radiochemicals. The terms "patient" and "subject" refer to any human or animal subject, particularly including all mammals. A "unit dose" refers to the quantity of radioactivity that is administered for medical imaging to a particular class of patient or subject. A unit dose of the radiopharmaceutical necessarily comprises a unit dose of a radioisotope.

As previously discussed, conventional radiopharmaceutical production focuses on generating a large amount of the radioisotope, typically on the order of Curies, in recognition of the significant radioactive decay that occurs during the relatively long time that the radioisotope undergoes processing and distribution. The improved biomarker generator of the present invention departs significantly from the established practice in that it is engineered to produce a per run maximum amount of radioisotope on the order of tens of millicuries. The micro-accelerator produces a maximum of approximately 2.59 GBq (70 mCi) of the desired radioisotope per production run. A particle accelerator producing a radioisotope on this scale requires significantly less beam power than conventional particle accelerators used for radiopharmaceutical production. The micro-accelerator generates a particle beam having a maximum beam power of 200 W. In various embodiments, the micro-accelerator generates a particle beam having a maximum beam power of approximately 200 W, 175 W, 150 W, 125 W, 100 W, 75 W, or 50 W. As a direct result of the dramatic reduction in maximum beam power, the micro-accelerator is significantly smaller and lighter than a conventional cyclotrons used in radiopharmaceutical production and requires less electricity. Many of the components of the micro-accelerator are less costly and less sophisticated compared to conventional cyclotrons used in radiopharmaceutical production.

Figure 3:
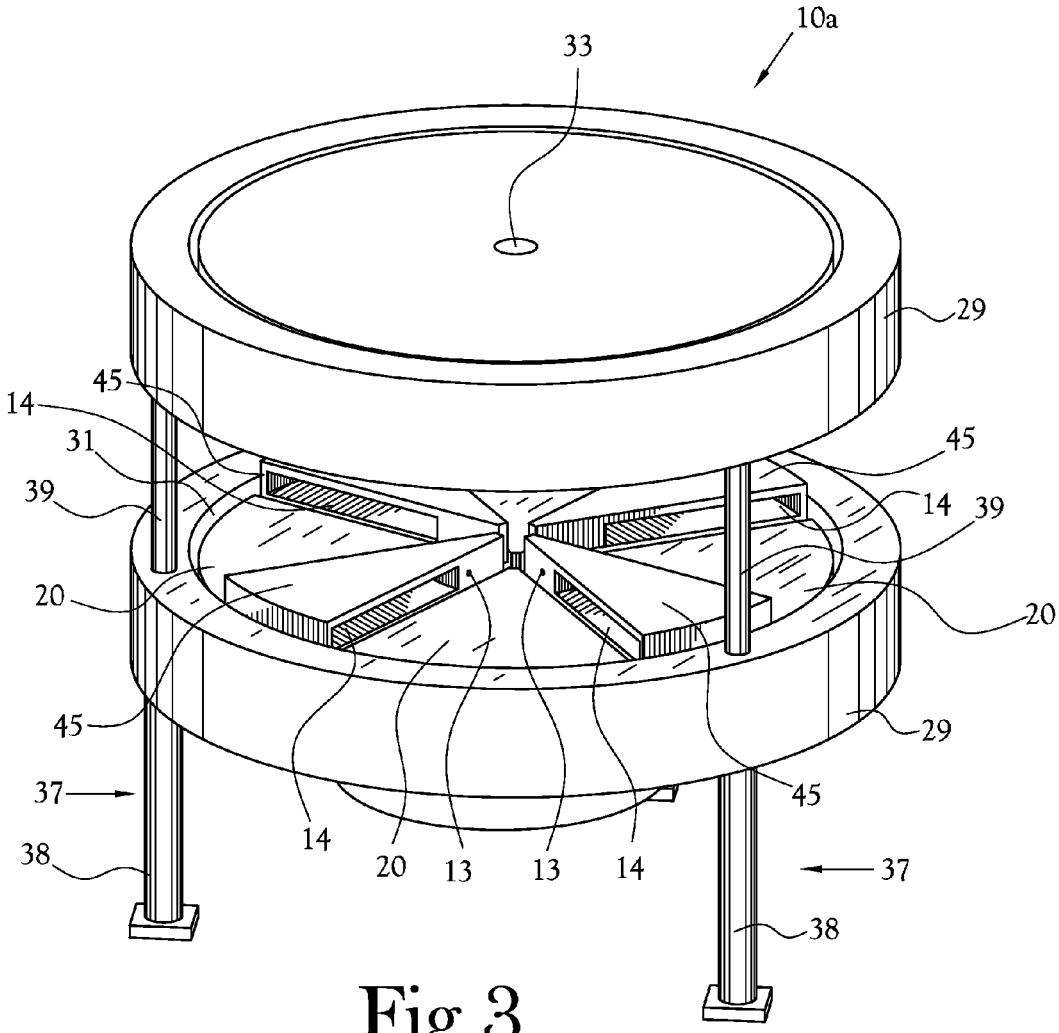
FIG. 3 is a perspective view one embodiment of a micro-accelerator suitable for use in the improved biomarker generator described herein, in the form of a cyclotron using permanent magnets, showing the micro-accelerator in an open configuration.
Figure 4:
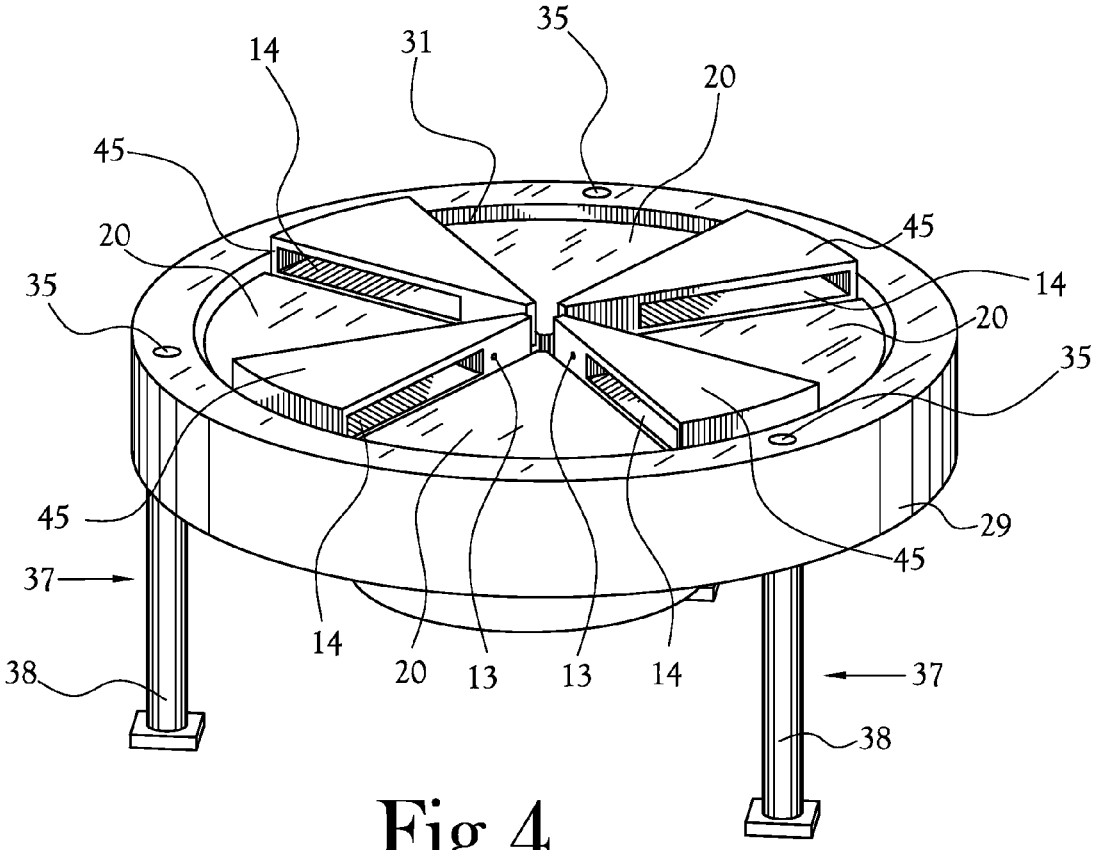
FIG. 4 is a perspective view of the lower platform of the micro-accelerator of FIG. 3.
Figure 5:
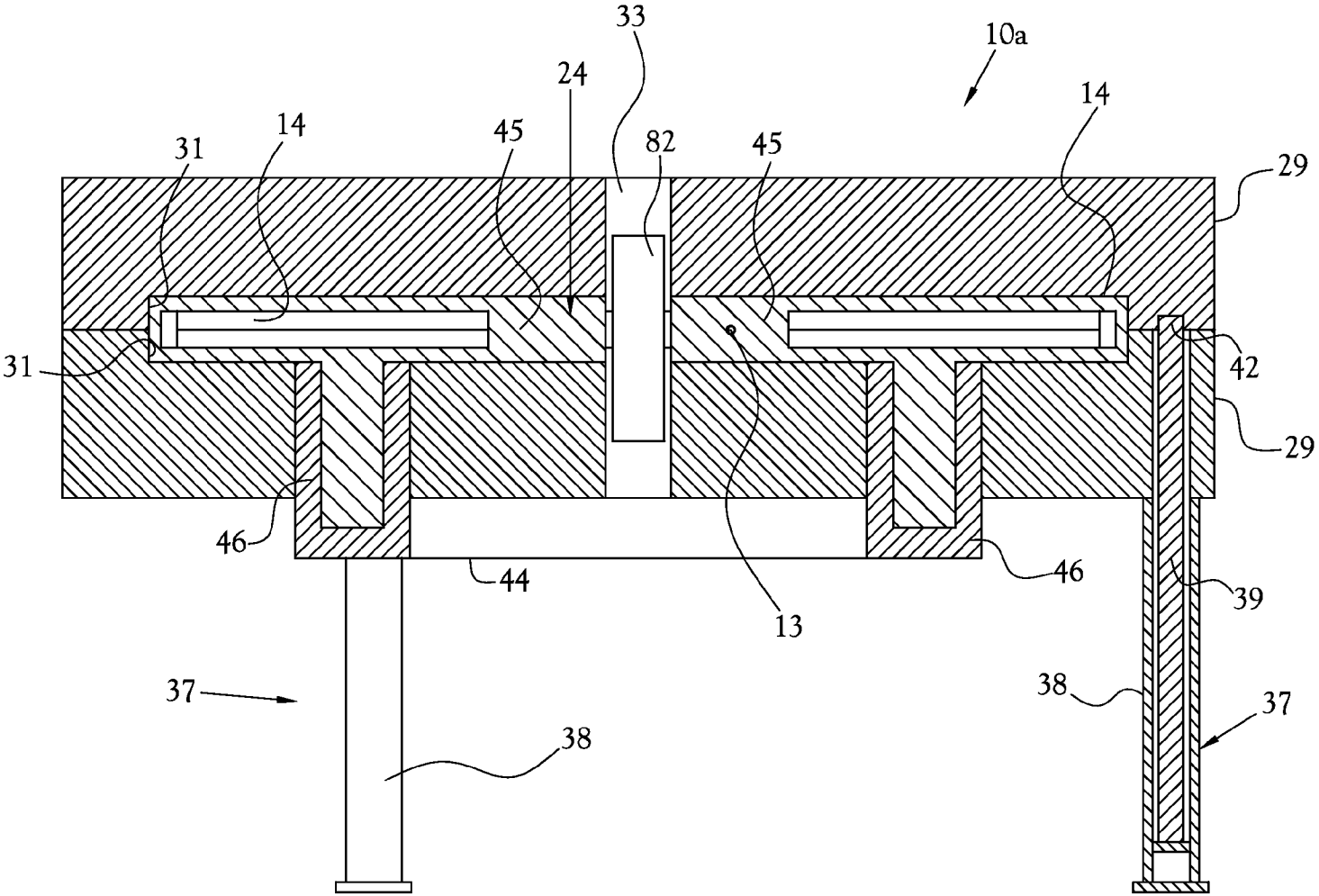
FIG. 5 is an elevation view, in cross-section taken along line 5-5 of FIG. 6, illustrating the micro-accelerator of FIG. 3 in a closed configuration.

FIGS. 3 illustrates one embodiment of a selected portion of a micro-accelerator in the form of a cyclotron using permanent magnets 10*a* (hereinafter a "permanent magnet cyclotron") with the upper and lower platforms in an open configuration. FIG. 4 omits the upper platform to provide an unobstructed view of the components in the lower platform. FIG. 5 is a cross-sectional view of the micro-accelerator of FIG. 3 shown with the upper and lower platforms 29 in a closed configuration. Each of the upper and lower platforms 29 defines a cavity 31 on the interior side thereof, such that when the upper and lower platforms 29 are engaged, the cavities 31 define an acceleration chamber 27. A plurality of permanent magnets 20 are arranged in a circular array in the cavities of each of the upper and lower platforms 29 to form the magnet poles. Each permanent magnet 20 carried by the upper platform forms an opposing pair with the corresponding permanent magnet 20 carried by the lower platform. The valleys between the respective pairs of permanent magnets 20 are occupied by a plurality of dees 45, with one dee being disposed in each valley. A centrally located ion injection opening 33 is defined through the upper and lower platforms 29 allowing the ion source 82 to generate ions at the center of the circular array of dees 45 and permanent magnets 20. As shown in FIG. 5, the micro-accelerator includes an RF system 44 in electrical communication with each of the dees 45 via a plurality of through-openings defined by the lower platform. A dee support 46 attached to each dee 45 extends through a corresponding through-opening and electrically connects the attached dee to the RF system 44.

Each of the permanent magnets 20 and the dees 45 are wedge-shaped. Each permanent magnet 20 has a first end positioned proximate to the center of the array and a second positioned proximate to the periphery of the array. Likewise, each dee 45 has a first end positioned proximate to the center of the array and an second end positioned proximate to the periphery of the array. Each of the dees 45 defines a main channel 14 through which ions travel as they are accelerated. When the dees 45 are disposed with the valleys, the faces of the permanent magnet pole tips are disposed in substantially the same plane as the side of the of the corresponding horizontal member of the dees that define the main channel 14. In the illustrated embodiment, the horizontal inner surfaces of the dees are substantially co-planar with the corresponding pole faces of the magnet pairs. When the upper and lower platforms 29 are engaged, a magnet gap is defined between corresponding permanent magnets 20 of the upper and lower platforms 29. Accordingly, the entire channel has a substantially homogeneous height, which provides an unobstructed flight path for the ions being accelerated therein.

The upper and lower platforms 29 are supported by a plurality of legs 37. In the illustrated embodiment and best viewed in FIG. 5, each leg 37 is defined by the body of a pneumatic or hydraulic cylinder 38. The lower platform defines a plurality of through openings 35 for slidably receiving a piston rod 39 of each of the cylinders 38. The distal end 42 of each piston rod 39 is connected to the upper platform. Thus, engagement of the upper and lower platforms 29 is accomplished by retraction of the piston rods 39 into the respective cylinders 38. Separation of the upper and lower platforms 29 is accomplished by extending the piston rods 39 from within the cylinders 38. While this construction is disclosed, it will be understood that other configurations are contemplated as well.

Figure 6:
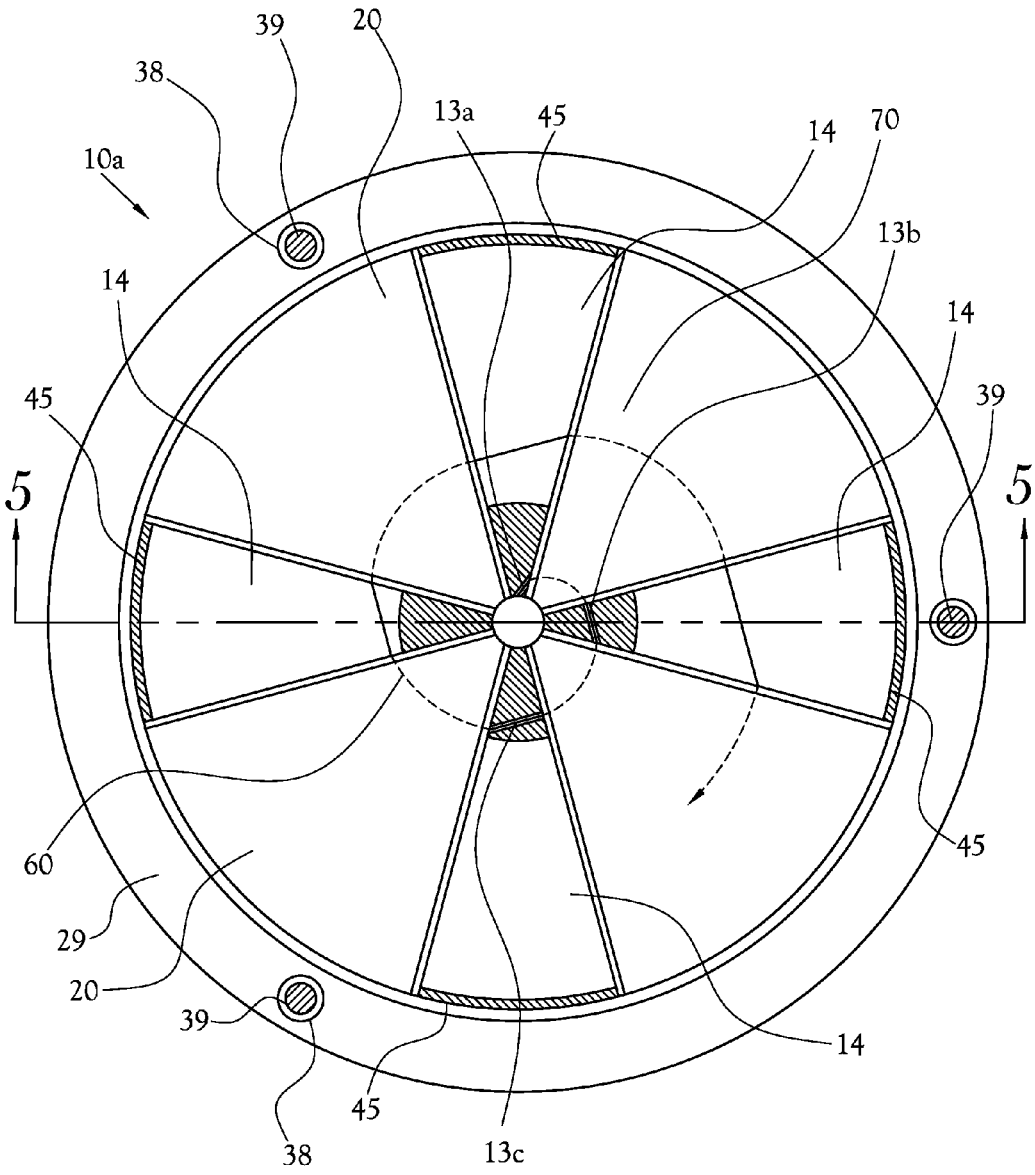
FIG. 6 is a plan view of the lower platform shown in FIG. 4 with the dees shown in cross-section to illustrate the flight path of the ions during acceleration.

FIG. 6 is a sectional top plan view of the permanent magnet cyclotron 10*a* showing the ion flight path 60. A series of collimator channels 13*a*, 13*b*, 13*c* are used to initially direct the path of the ions introduced at the center of the array. Each collimator channel 13*a*, 13*b*, 13*c* defines an outlet into the gap between corresponding permanent magnets 20 carried by the upper and lower platforms 29. In the illustrated embodiment, a first collimator channel 13*a* accepts ions introduced at the center of the array that are excited to a desired initial energy. Ions exiting the first collimator channel 13*a* travel along a generally arcuate course across the interposed hill and enter the second collimator channel 13*b*. Similarly, ions exiting the second collimator channel 13*b* travel across the interposed hill and enter the third collimator channel 13*c*. The first, second and third collimator channels 13*a*, 13*b*, 13*c* are configured to define the first revolution of the ions during acceleration. Ions that lack the desired initial energy level are rejected by not allowing such ions to enter the first collimator channel 13*a*. After exiting the third collimator channel 13*c*, the ions travel through the main channels 14 defined by each of the dees 45 until the desired energy level is achieved.

The permanent magnet cyclotron 10*a* provides substantial improvements with respect to cost and reliability when compared to conventional cyclotrons producing particle beams with energies of 10 MeV or less using electromagnets or superconducting magnets. Because the permanent magnet cyclotron 10*a* allows for the exclusion of the electromagnetic coils of the common to conventional radiopharmaceutical cyclotrons, the volume and weight are significantly reduced. In one embodiment, the volume and weight of the micro-accelerator are 40% of the volume and weight of conventional radiopharmaceutical cyclotrons, with a corresponding minimum equipment cost savings of approximately 25% of the equipment cost of conventional radiopharmaceutical cyclotrons. Additionally, eliminating the electric power needed to excite the electromagnet coils in a conventional cyclotron magnet significantly reduces the power requirements and realizes a significant savings in energy usage. The power requirements are further reduced as a result of the lower acceleration voltage of 8 MeV to 10 MeV or less applied to the dees. As a result of these improvements, the reliability of the permanent magnet cyclotron 10*a* is enhanced as compared to conventional radiopharmaceutical cyclotrons. As a result of the smaller size and lighter weight, more facilities are capable of operating the present invention, especially in situations where space is of concern. Further, because of the ultimately reduced purchase and operating costs, the permanent magnet cyclotron 10*a* is also more affordable. While the permanent magnet cyclotron 10*a* is presently not practical for higher acceleration voltages due to the increased magnetic field requirements of the permanent magnets, such embodiments are not excluded from the spirit of the present invention.

Figure 7:
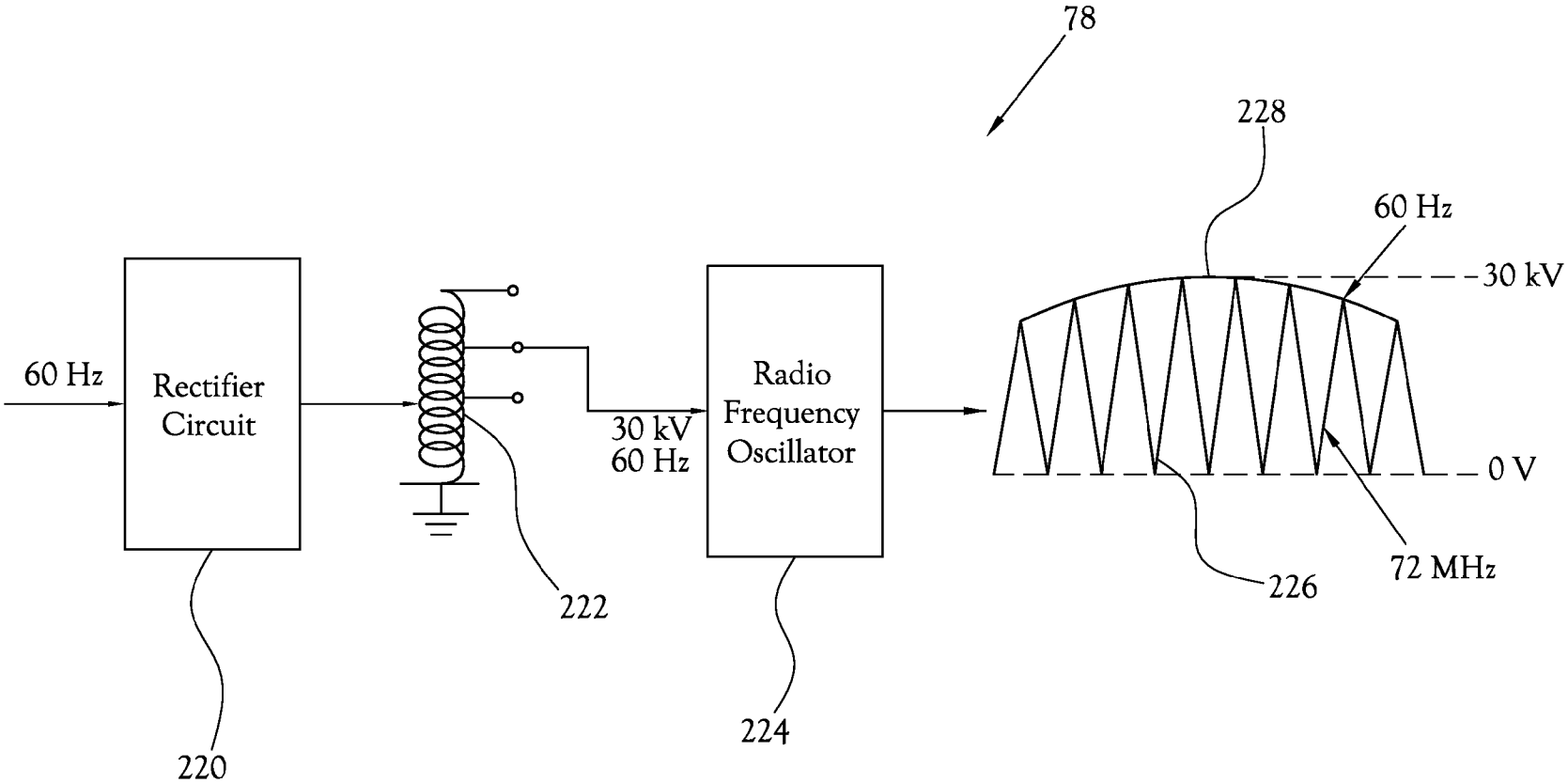
FIG. 7 illustrates one embodiment of radio frequency (RF) system for a micro-accelerator suitable for use in the improved biomarker generator described herein.

FIG. 7 is a block diagram of an improved RF system used in one embodiment of the micro-accelerator (hereinafter the "improved RF cyclotron"). The improved RF system includes a rectifier circuit 220 that accepts line voltage and produces a rectified voltage signal. The rectifier circuit 220 is a full wave rectifier incorporating two or more diodes, such as a dual diode rectifier. In one embodiment, the rectified voltage signal is the positive portion of the line voltage. The rectified voltage signal supplies the input of a high voltage step-up transformer 222 capable of supplying a high voltage and high current RF supply signal. In one embodiment, the step-up transformer is an autotransformer producing an output voltage of 30 kV at the line voltage frequency, e.g., 60 Hz. The RF oscillator 224 uses the RF supply signal to produce an RF signal at a selected frequency based on the resonance frequency of the RF oscillator 224 and having a peak-to-peak voltage corresponding to the peak voltage of the RF supply signal. The resonance frequency and the peak-to-peak voltage are selected to accelerate the charged particles to a selected energy level. The resulting RF signal drives the polarity of the dees to accelerate the charged particles. However, acceleration of positively charged particles occurs only during the positive portion of the 60 Hz cycle. By applying full wave rectification, the acceleration periods occur twice as often. For the production of radioisotopes useful in positron emission tomography imaging, only small amounts of radioactivity are necessary. By increasing the beam current, the improved RF cyclotron compensates for having acceleration during only a small portion of the 60 Hz cycle. In the illustrated embodiment, the resonance frequency of the RF oscillator is 72 MHz producing an RF signal having a frequency of 72 MHz with a maximum peak-to-peak voltage of 30 kV enveloped in the 60 Hz line voltage frequency.

To facilitate low-power operation, the ion source of one embodiment of the micro-accelerator is optimized for positive ion production. Beams of positively-charged particles generally are more stable than beams of negatively-charged particle because the reduced likelihood of losing an electron at the high velocities that charged particles experience in a cyclotron. Losing an electron usually causes the charged particle to strike an interior surface of the cyclotron and generate additional radiation. Minimizing the production of excess radiation reduces the amount of shielding required. Additionally, a positive ion cyclotron requires significantly less vacuum pumping equipment. Reducing the amount of shielding and vacuum pumping equipment reduces the size, weight, cost, complexity, power requirements, and power consumption of the cyclotron. In one embodiment, the ion source is optimized for proton ($H^+$) production. In an alternate embodiment, the ion source is optimized for deuteron ($^2H^+$) production. In another embodiment, ion source is optimized for alpha particle ($He^{2+}$) production.

Figure 8:
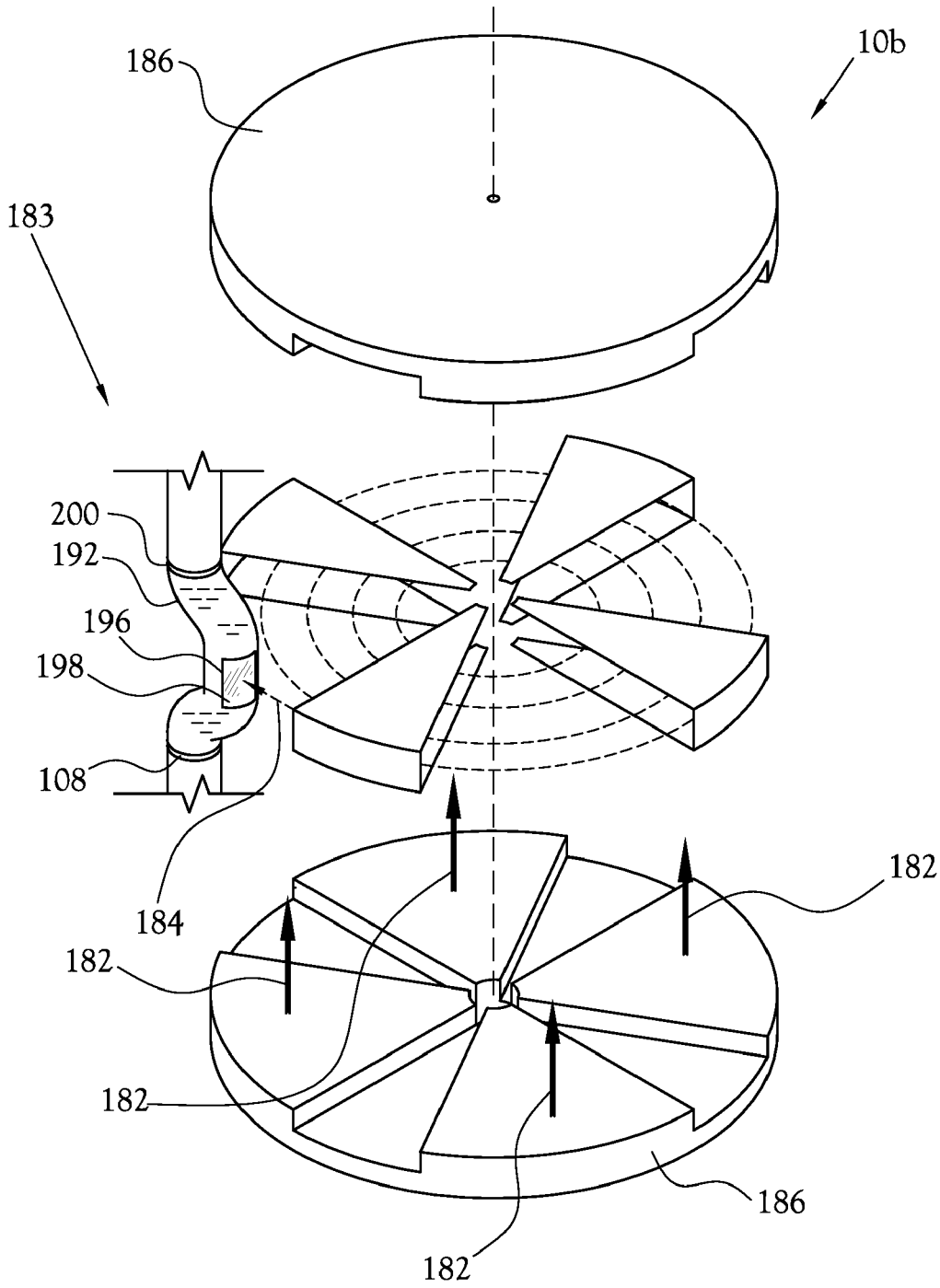
FIG. 8 is an exploded illustration of one embodiment of a micro-accelerator incorporating an internal target, suitable for use in the improved biomarker generator described herein.

FIG. 8 illustrates one embodiment of the micro-accelerator 10*b* in the form of a positive ion cyclotron (hereinafter "internal target cyclotron") where the target 183 (hereinafter "internal target") is located within the magnetic field. In this embodiment, the positive ion particle beam 184 irradiates the internal target 183 while still within the magnetic field 182 produced by the opposing magnet poles 186, 188. Consequently, the magnet system assists in containing harmful radiation related to the nuclear reaction that converts the target substance into a radioisotope. The internal target 183 eliminates a major source of radiation inherent in a conventional positive-ion cyclotron by eliminating the need for the conventional extraction blocks. In their absence, much less harmful radiation is generated. Thus, the internal target 183 eliminates a considerable disadvantage for positive-ion cyclotrons. A reduction in harmful radiation generation translates into a reduction in the amount of shielding and the associated benefits discussed above.

In the illustrated embodiment, the internal target 183 includes a stainless steel tube 192 that conducts the target substance. The stainless steel tube 192 has a target section centered in the path that the particle beam 184 travels following the final increment of acceleration. The longitudinal axis of the target section is substantially parallel to the magnetic field 182 generated by the magnet system and substantially perpendicular to the electric field generated by the RF system. The remainder of the stainless steel tube 192 is selectively shaped and positioned such that it does not otherwise obstruct the path followed by the particle beam 184 during or following its acceleration. The internal target 183 defines an opening 196 that is positioned in a path of the particle beam 184. A target window 198, which comprises a very thin layer of a foil such as aluminum, seals the opening 196 and prevents the target substance from escaping. Also, a pair of valves 200 control the flow of the target substance and hold a selected volume of the target solution in place for irradiation by the particle beam 184.

The diameter of the stainless steel tube 192 varies depending on the configuration of the internal target cyclotron 10*b*. Generally, the diameter is less than or equal to the increase in the orbital radius of the charged particles over one orbit, which in this embodiment is approximately four millimeters. Thus, in one embodiment, the diameter of the stainless steel tube 192 is approximately four millimeters. Because the charged particles gain a predetermined fixed quantity of energy that is manifested by an incremental fixed increase in the orbital radius of the beam, the charged particles do not interact with the stainless steel tube 192 prior to the final increment of acceleration, which would result in an undesirable situation that reduces the efficiency of the particle beam 184.

The micro-accelerator is designed to produce a particle beam in which the charged particles have an average energy sufficient to overcome the binding energy of the target isotope. In the area of radiopharmaceutical production, the minimum effective average energy of the charged particles is 5 MeV. Higher average particle energies result in more efficient radioisotope production and shorter production times. The micro-accelerator 112 produces a particle beam of charged particles with an average energy in the range of 5 MeV to 18 MeV. In one embodiment, the charged particles have an average energy in the range of 5 MeV to 10 MeV. In another embodiment, the charged particles have an average energy in the range of 7 MeV to 10 MeV. In another embodiment of the micro-accelerator 112, the charged particles have an average energy in the range of 8 MeV to 10 MeV. In yet another embodiment of the micro-accelerator 112, the charged particles have an average energy in the range of 7 MeV to 18 MeV. In more specific embodiments of the micro-accelerator 112, the charged particles are protons, deuterons, or alpha particles with an average energy in the range of 5 MeV to 18 MeV, 5 MeV to 10 MeV, 7 MeV to 10 MeV, 8 MeV to 10 MeV, or 7 MeV to 18 MeV. In a further embodiment, the micro-accelerator 112 generates a particle beam with a beam current of approximately 1 μA consisting essentially of protons having an energy of approximately 7 MeV, the particle beam having beam power of approximately 7 W and being collimated to a diameter of approximately 1 mm.

At lower average particle energies, fewer charged particles will be successful in destabilizing the target isotope and production time increases. As production time increases to a point that it is significant with respect to the half-life of the radioisotope, some of the radioisotope that has been produced will decay. The quantities of the radioisotope for which the micro-accelerator is designed are small enough to be practicable even when the ratio of production to decay is small. The various embodiments of the micro-accelerator are limited to producing a radioisotope with a maximum radioactivity of approximately 2.59 GBq (70 mCi) per production run. In one embodiment, the micro-accelerator produces a maximum of approximately 0.666 GBq (18 mCi) of fluorine-18 per production run. In another embodiment, the micro-accelerator produces a maximum of approximately 0.185 GBq (5 mCi) of fluorine-18 per production run. In yet another embodiment, the micro-accelerator produces a maximum of approximately 1.11 GBq (30 mCi) of carbon-11 per production run. In further embodiment, the micro-accelerator produces a maximum of approximately 1.48 GBq (40 mCi) of nitrogen-13 per production run. In still further embodiment, the micro-accelerator produces a maximum of approximately 2.22 GBq (60 mCi) of oxygen-15 per production run. Such embodiments of the micro-accelerator are flexible in that they can provide an adequate quantity of radioisotope for each of various classes of patients and subjects that undergo PET imaging.

The improved biomarker generator of the present invention may be embodied in many different forms. The permanent magnet cyclotron 10*a*, the improved RF cyclotron, and the internal target cyclotron 10*b* are examples of suitable components for use in a particle accelerator optimized as a micro-accelerator. Moreover, the various features of the permanent magnet cyclotron 10*a*, the improved RF cyclotron, and the internal target cyclotron 10*b* can be mixed and matched in a single micro-accelerator. Thus, one embodiment of the micro-accelerator is a combination of the permanent magnet cyclotron 10*a* with the internal target 183 of the internal target cyclotron 10*b*. Another embodiment of the micro-accelerator is a combination of the permanent magnet cyclotron 10*a* with the improved RF system. Yet another embodiment of the micro-accelerator is a combination of the internal target cyclotron 10*b* with the improved RF system. A still further embodiment is the combination of the permanent magnet cyclotron 10*a* with the improved RF system and the internal target 183 of the internal target cyclotron 10*b*.

Variations in the overall architecture of the micro-accelerator and the radiopharmaceutical micro-synthesis system are contemplated. For example, one embodiment, the micro-accelerator is a two-pole cyclotron. In another embodiment, the micro-accelerator is a four-pole cyclotron. Using a four-pole cyclotron may be advantageous in certain applications, because a four-pole cyclotron accelerates charged particles more quickly than a two-pole cyclotron using an equivalent accelerating voltage. The micro-accelerator described herein emphasizes the generation of a positively-charged particle beam; however, the acceleration of negatively-charged particles is necessary for certain applications and is considered within the scope of the present invention. The micro-accelerator described herein emphasizes the use of permanent magnets; however, the use of small electromagnets (weighing up to approximately 3 tons) is not outside the scope of the present invention for certain applications where a higher beam power is required. While the foregoing discussion emphasizes the use of a micro-accelerator, other types of particle accelerators may be used for production of the particle beam. Acceptable alternatives for the cyclotron include linear accelerators, radiofrequency quadrupole accelerators, and tandem accelerators. The production quantities, the ion source types, and the particle beam energies, ranges, diameters, particles, and powers apply to the various embodiments and modifications of the micro-accelerators.

Figure 9:
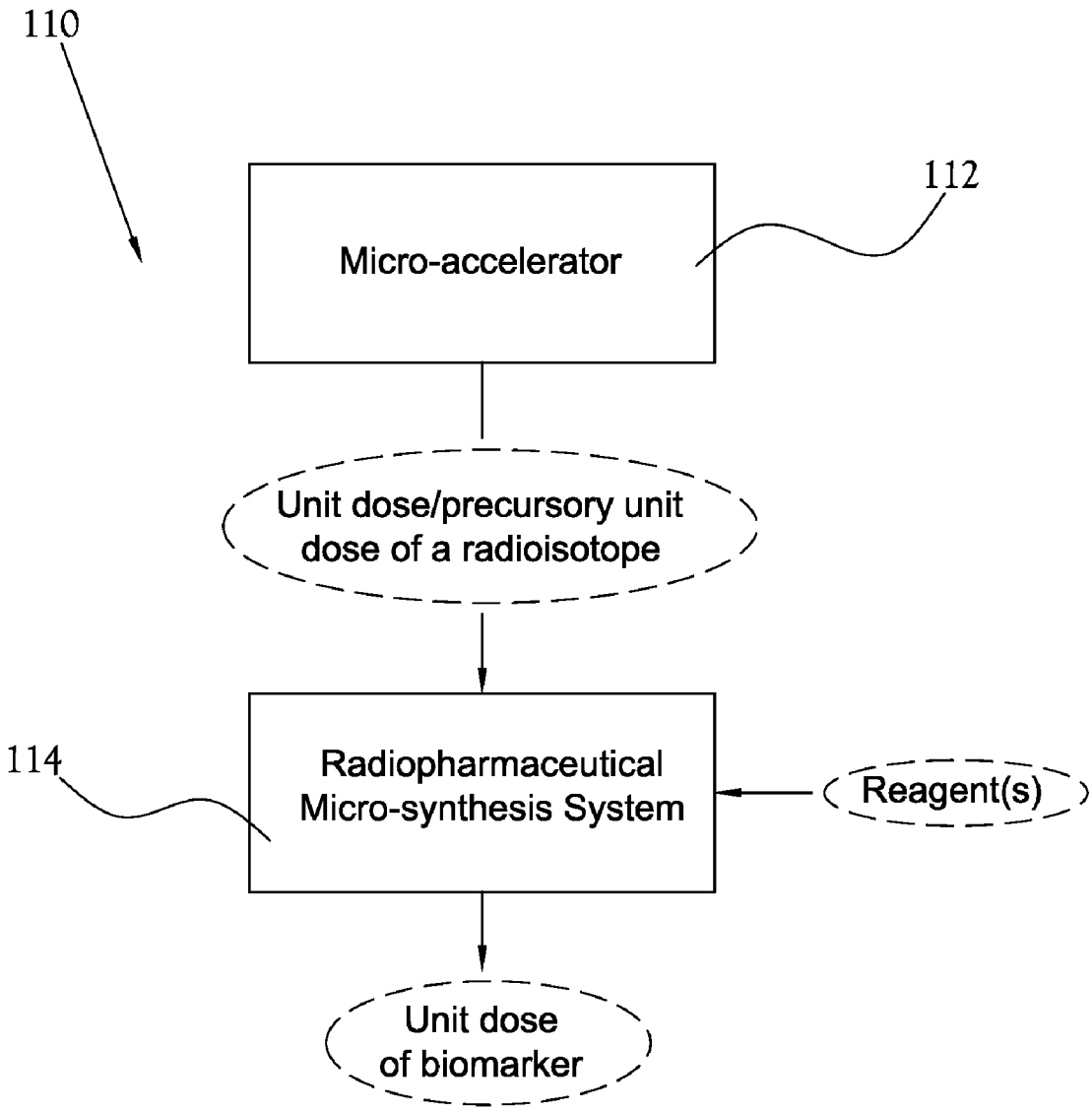
FIG. 9 is a block diagram of the improved biomarker generator described herein for producing a unit dose of a biomarker.

FIG. 9 illustrates one embodiment of the improved biomarker generator including a micro-accelerator 112 and a radiopharmaceutical micro-synthesis system 114, which as previous indicated incorporates at least one of a microreactor and microfluidic chip. As part of the complete improved biomarker generator, the radiopharmaceutical micro-synthesis system 114 will necessarily be configured to process the quantity of the radioisotope produced by the micro-accelerator 112. Microreactors and microfluidic chips typically perform their respective functions in less than 15 min, some in less than 2 min. This significant reduction in processing time directly allows a reduction in the quantity of the radioisotope required to synthesis the desired biomarker. A microfluidic chip exercises digital control over variables such as the duration of the various stages of a chemical process, which leads to a well-defined and narrow distribution of residence times. Such control also enables extremely precise control over flow patterns within the microfluidic chip. The use of a microfluidic chip facilitates the automation of multiple, parallel, and/or sequential chemical processes.

Figure 10:
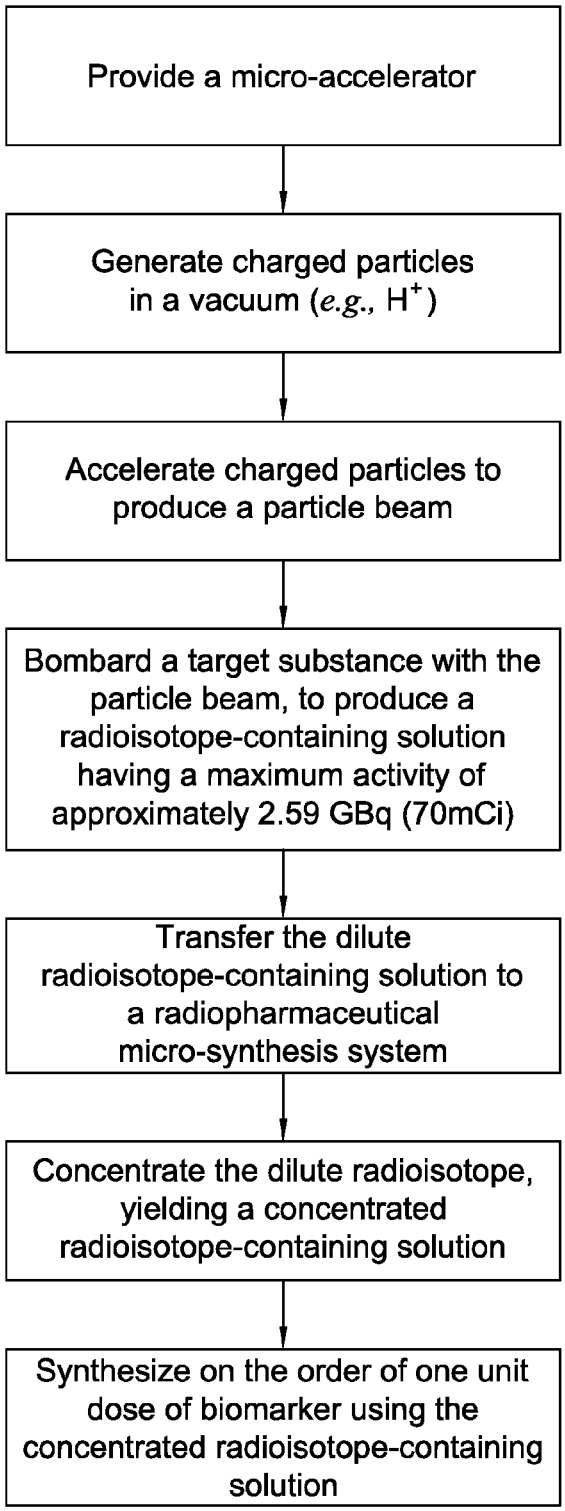
FIG. 10 is a flow diagram of one embodiment of the method for producing approximately one unit dose of a biomarker using the improved biomarker generator described herein.

FIG. 10 is a flow diagram of one embodiment of the method for producing a radiopharmaceutical using the improved biomarker generator. The method calls for providing a micro-accelerator, producing charged particles, accelerating the charged particles, and forming a particle beam to irradiate a target substance and produce a radioisotope. As an example, in the production of no-carrier-added fluorine-18, a particle beam of protons bombards the target substance of [$^{18}$O]water. The protons in the particle beam interact with the oxygen-18 isotope in the [$^{18}$O]water molecules . The improved biomarker generator allows operation using a volume of the target substance that is unusually small in the area of radiopharmaceutical production. A sufficient quantity of a fluorine-18 can be produced using a [$^{18}$O]water target substance with a volume of approximately 1 mL because the maximum mass of the radioisotope required to produce a unit dose of a radiopharmaceutical is on the order of nanograms. The internal target 183 discussed above is particularly well-suited for handling target substance volumes on this scale. While this example contemplates the use of a liquid target substance, one skilled in the art will recognize that certain methods of producing a radioisotope or radiolabeled precursor require an internal target that can accommodate a gaseous or solid target substance. Further, while the example given contemplates the production of fluorine-18, the internal target may be modified to enable the production of other radioisotopes or radiolabeled precursors, including [$^{11}$C]$CO_2$ and [$^{11}$C]$CH_4$, both of which are widely used in research. Such embodiments are considered to be within the scope and spirit of the present invention.

After irradiation, the radioisotope and at least one reagent are transferred to the radiopharmaceutical micro-synthesis system 114. The radioisotope undergoes processing such as concentration, as necessary. Ultimately, the radiopharmaceutical micro-synthesis system 114 combines the radioisotope with the reagent to synthesize the biomarker. In this context, a reagent is a substance used in synthesizing the biomarker because of the chemical or biological activity of the substance. Examples of a reagent include a solvent, a catalyst, an inhibitor, a biomolecule, and a reactive precursor. A reactive precursor is an organic or inorganic non-radioactive molecule that, in synthesizing a biomarker or other radiopharmaceutical, is reacted with a radioisotope, typically by nucleophilic substitution, electrophilic substitution, or ion exchange. The chemical nature of the reactive precursor varies and depends on the physiological process that has been selected for imaging. Exemplary organic reactive precursors include sugars, amino acids, proteins, nucleosides, nucleotides, small molecule pharmaceuticals, and derivatives thereof. Synthesis refers to the production of the biomarker by the union of chemical elements, groups, or simpler compounds, or by the degradation of a complex compound, or both. Synthesis, therefore, includes any tagging or labeling reactions involving the radioisotope and any processes (e.g., concentration, evaporation, distillation, enrichment, neutralization, and purification) used in producing the biomarker or in processing the target substance for use in synthesizing the biomarker. The latter is especially important in instances where (1) the volume of the target substance is too great to be manipulated efficiently within some of the internal structures of the radiopharmaceutical micro-synthesis system and/or (2) the concentration of the radioisotope in the target substance is lower than is necessary to optimize the synthesis reaction(s) that yield the biomarker. Accordingly, one embodiment of the radiopharmaceutical micro-synthesis system incorporates integrated separation components providing the ability to concentrate the radioisotope. Examples of suitable separation components include ion-exchange resins, semi-permeable membranes, or nanofibers. Such separations via semi-permeable membranes usually are driven by a chemical gradient or electrochemical gradient. Another example of processing the target substance includes solvent exchange. Continuing the example from above, the concentration of fluorine-18 obtained from a proton bombardment of [$^{18}$O]water is usually below 1 ppm. This dilute solution needs to be concentrated to approximately 100 ppm in order to optimize the kinetics of the biomarker synthesis reactions. This processing occurs in the radiopharmaceutical micro-synthesis system 114.

The improved biomarker generator enables the small scale in-situ production of a radioisotope and synthesis of biomarkers. Thus, the micro-accelerator 112 produces a sufficient quantity of the radioisotope for the radiopharmaceutical micro-synthesis system 114 to synthesize of the biomarker on the order of a unit dose of the biomarker. In one embodiment, the micro-accelerator 112 generates the radioisotope in a quantity on the order of a unit dose. In another embodiment, the micro-accelerator 112 generates the radioisotope in a quantity on the order of a precursory unit dose of the radioisotope. A precursory unit dose of the radioisotope is a dose of radioisotope that, after decaying for a length of time approximately equal to the time required to synthesize the biomarker, yields a quantity of biomarker having a quantity of radioactivity approximately equal to the unit dose appropriate for the particular class of patient or subject undergoing PET. For example, if the radiochemical synthesis system requires 20 min to synthesize a unit dose of a biomarker comprising carbon-11 ($t_{1/2}$=20 min), the precursory unit dose of the carbon-11 radioisotope has an radioactivity equal to approximately 200% times the radioactivity of a unit dose of the biomarker in order to compensate for the radioactive decay. Similarly, if the radiopharmaceutical micro-synthesis system requires 4 min to synthesize a unit dose of a biomarker labeled with oxygen-15 ($t_{1/2}$=2 min), the precursory unit dose of the oxygen-15 radioisotope has an radioactivity equal to approximately 400% times the radioactivity of a unit dose of the biomarker in order to compensate for the radioactive decay.

In some instances, the precursory unit dose of the radioisotope may be used to compensate for a radiopharmaceutical micro-synthesis system having a yield fraction that is significantly less than 100% of the radioactivity supplied. Further, the precursory unit dose may be used to compensate for radioactive decay during the time required in administering the biomarker to the patient or subject. One skilled in the art will recognize that the synthesis of a biomarker comprising a positron-emitting radioisotope should be completed within approximately the two half-lives of the radioisotope immediately following the production of the unit or precursory unit dose to avoid the significant increase in inefficiency that would otherwise result.

Although the foregoing description emphasizes the production of biomarkers labeled with fluorine-18, such as [$^{18}$F] FDG, the radiopharmaceutical micro-synthesis system is flexible and may be used to synthesize biomarkers labeled with other radioisotopes, such as carbon-11, nitrogen-13, or oxygen-15. Further, the improved biomarker generator discussed herein is flexible enough to produce quantities on the order of a unit dose of biomarkers that are labeled with radioisotopes that do not emit positrons or for producing small doses of radiopharmaceuticals other than biomarkers. One skilled in the art will recognize also that the radiopharmaceutical micro-synthesis system may comprise parallel circuits, enabling simultaneous production of unit doses of a variety of biomarkers. Finally, one skilled in the art will recognize that the improved biomarker generator may be engineered to produce unit doses of biomarker on a frequent basis.

From the foregoing description, it will be recognized by those skilled in the art that an improved biomarker generator has been provided. The improved biomarker generator described herein allows for the nearly on-demand production of a biomarker in a quantity on the order of one unit dose. Because the half-lives of the radioisotopes most suitable for safe molecular imaging of a living organism are very short, nearly on-demand production of unit doses of biomarkers presents a significant advancement for both clinical medicine and biomedical research. The reduced size, weight, and cost, the reduced infrastructure (power and structural) requirements, and the improved reliability of the micro-accelerator coupled with the speed and overall efficiency of the radiopharmaceutical micro-synthesis system make in-house biomarker generation a viable option even for small regional hospitals. The various embodiments of the micro-accelerator generate the magnetic field using permanent magnets, move the target into the magnetic field allowing the magnet system to help contain radiation generated during radioisotope production, incorporate the improved RF system described herein, and use combinations of these features to provide the aforementioned improvements over conventional cyclotrons used in radiopharmaceutical production.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A system for producing a radiopharmaceutical, said system comprising:

a particle accelerator for generating a beam of charged particles having a maximum beam power of less than, or equal to, approximately 200 W, the beam consisting essentially of particles having a minimum energy greater than, or equal to, 5 MeV, and for directing the beam of charged particles along a path;

a target positioned in the path of the beam of charged particles, said target serving to receive a target substance having a composition selected for producing a radioactive substance during interaction with the beam of charged particles; and a radiopharmaceutical micro-synthesis system having at least one microreactor and/or microfluidic chip, said radiopharmaceutical micro-synthesis system for receiving the radioactive substance, receiving at least one reagent, and synthesizing the radiopharmaceutical.

2. A biomarker generator for producing radiopharmaceuticals, said biomarker generator comprising:

a target for holding a target substance that produces a selected radioisotope when bombarded by charged particles accelerated to energies greater than or equal to the nuclear binding energy of the target substance;

a particle accelerator for generating a particle beam having a maximum beam power of 200 W, said particle beam comprising charged particles with an average energy at least equal to the nuclear binding energy of said target substance, said particle accelerator configured to bombard said target substance with said charged particles and produce said selected radioisotope; and a radiopharmaceutical micro-synthesis system comprising at least one microreactor or microfluidic chip, said radiopharmaceutical micro-synthesis system synthesizing a radiopharmaceutical from the selected radioisotope.

3. The biomarker generator of claim 2 wherein said average energy of said charged particles is within a range selected from the group consisting of 5 MeV to 18 MeV, 5 MeV to 10 MeV, 7 MeV to 10 MeV, 8 MeV to 10 MeV, and 7 MeV to 18 MeV.

4. The biomarker generator of claim 3 wherein said average energy of said charged particles is in the range of 5 MeV to 10 MeV.

5. The biomarker generator of claim 2 wherein said particle accelerator is a cyclotron and said charged particles are selected from the group consisting of protons and deuterons.

6. The biomarker generator of claim 5 wherein the target is located within a magnetic field generated by said cyclotron, said particle beam bombarding said target substance without exiting said magnetic field.

7. The biomarker generator of claim 2 wherein said charged particles are selected from the group consisting of protons and deuterons and wherein said average energy of said charged particles is in the range of 5 MeV to 10 MeV and said maximum beam power is 200 W.

8. The biomarker generator of claim 2 wherein said maximum beam power is selected from the group consisting of 50 W, 75 W, 100 W, 125 W, 150 W, and 175 W.

9. The biomarker generator of claim 8 wherein said maximum beam power is 50 W.

10. The biomarker generator of claim 2 producing said selected radioisotope per production run in a maximum quantity of approximately 2.59 GBq (70 mCi).

11. The biomarker generator of claim 2 wherein said selected radioisotope is $^{18}$F and said radiopharmaceutical is

[$^{18}$F]2-fluoro-2-deoxy-D-glucose, said particle accelerator producing a run of fluorine-18 with a maximum radioactivity selected from the group of approximately 0.666 GBq (18 mCi) and approximately 0.185 GBq (5 mCi).

12. A biomarker generator for producing on the order of one unit dose of a radiopharmaceutical, comprising:

a target for holding a target substance that produces a selected radioisotope when bombarded by charged particles accelerated to energies greater than or equal to the nuclear binding energy of the target substance;

a cyclotron for generating a particle beam having a maximum beam power in the range of 200 W, said particle beam comprising charged particles selected from the group consisting of protons and deuterons with an average energy in the range of 5 MeV to 10 MeV, said particle accelerator configured to bombard said target substance with said charged particles and produce said selected radioisotope; and a micro-reaction device for synthesizing a radiopharmaceutical from the selected radioisotope, said micro-reaction device comprising components selected from the group consisting of microfluidic reactors and microfluidic chips.

13. The biomarker generator of claim 12 wherein the target is located within a magnetic field generated by said cyclotron, said particle beam bombarding said target substance without exiting said magnetic field.

14. The biomarker generator of claim 12 producing said selected radioisotope per production run in a maximum quantity of approximately 2.59 GBq (70 mCi).

15. The biomarker generator of claim 12 wherein said selected radioisotope is $^{18}$F and said radiopharmaceutical is [$^{18}$F]2-fluoro-2-deoxy-D-glucose, said particle accelerator producing a run of fluorine-18 with a maximum radioactivity selected from the group of approximately 0.666 GBq (18 mCi) and approximately 0.185 GBq (5 mCi).

16. The biomarker generator of claim 12 wherein said maximum beam power is selected from the group consisting of 50 W, 75 W, 100 W, 125 W, 150 W, and 175 W.

17. The biomarker generator of claim 16 wherein said maximum beam power is 50 W.

18. A method of producing on the order of one unit dose of a radiopharmaceutical, said method comprising the steps of:

providing a target substance that produces a selected radioisotope when bombarded by charged particles accelerated to energies greater than or equal to the nuclear binding energy of the target substance;

generating a particle beam of charged particles with a maximum beam power of 200 W, said charged particles selected from the group consisting of protons and deuterons, said charged particles accelerated to an average energy at least equal to the nuclear binding energy of said target substance;

producing said radioisotope in a maximum quantity per production run on the order of one precursory unit dose from said target substance by bombarding said target substance with said charged particles;

synthesizing said radioisotope into a maximum quantity of a radiopharmaceutical on the order of one unit dose using a micro-reaction device selected from the group consisting of microfluidic reactors and microfluidic chips.

19. The method of claim 18 wherein said step of generating a particle beam further comprising the step of providing a cyclotron to generate a particle beam, said method further comprising the steps of:

locating the target substance in a magnetic field generated by said cyclotron; and bombarding said target substance with said particle beam without said particle beam exiting said magnetic field.

20. The method of claim 18 wherein said maximum quantity of said selected radioisotope produced per production run is approximately 2.59 GBq (70 mCi).

21. The method of claim 18 wherein said selected radioisotope is $^{18}$F and said radiopharmaceutical is [$^{18}$F]2-fluoro-2-deoxy-D-glucose, said maximum quantity of said selected radiopharmaceutical produced per production run selected from the group of approximately 0.666 GBq (18 mCi) and approximately 0.185 GBq (5 mCi).

22. The method of claim 18 wherein said maximum beam power is selected from the group consisting of 50 W, 75 W, 100 W, 125 W, 150 W, and 175 W.

23. The method of claim 22 wherein said maximum beam power is 50 W.

24. The method of claim 18 wherein said average energy of said charged particles is within a range selected from the group consisting of 5 MeV to 18 MeV, 5 MeV to 10 MeV, 7 MeV to 10 MeV, 8 MeV to 10 MeV, and 7 MeV to 18 MeV.

25. The method of claim 24 wherein said average energy of said charged particles is in the range of 5 MeV to 10 MeV.

26. The method of claim 18 wherein said charged particles are selected from the group consisting of protons and deuterons and wherein said average energy of said charged particles is in the range of 5 MeV to 10 MeV and said maximum beam power is 200 W.

* * * * *